US005827007A

United States Patent [19]

Barton et al.

[11] Patent Number: 5,827,007

[45] Date of Patent: Oct. 27, 1998

[54] ENTRANCE-DETERRING CAP FOR MANHOLE OPENINGS

[76] Inventors: David L. Barton, 19 Wiltshire Dr., Avondale Estates, Ga. 30002; Patrick Scott Kelly, 50 Blackberry La., Covington, Ga. 30209

[21] Appl. No.: 665,287

[22] Filed: Jun. 17, 1996

Related U.S. Application Data

[60] Provisional application No. 60/016,574 Apr. 30, 1996.

[51] Int. Cl.[6] ..... E02D 29/14

[52] U.S. Cl. ..... 404/25; 52/20

[58] Field of Search ..... 52/19, 20, 21; 404/25, 26

[56] References Cited

U.S. PATENT DOCUMENTS

| | | | |
|---|---|---|---|
| 4,650,365 | 3/1987 | Runnels | 404/26 X |
| 4,919,564 | 4/1990 | Neathery et al. | 404/25 |
| 5,253,952 | 10/1993 | Selway | 404/25 |
| 5,295,535 | 3/1994 | Boles et al. | 404/25 X |
| 5,383,311 | 1/1995 | Strickland | 52/20 |
| 5,401,114 | 3/1995 | Guggemos | 404/25 |
| 5,727,351 | 3/1998 | Neathery et al. | 52/20 |

OTHER PUBLICATIONS

The "Rainstopper" brochure, Southwestern Packing & Seals, Shreveport, LA 71133–3997 (undated).

Tetherlock™ Stainless Steel "Rainstopper" brochure, Southwestern Packing & Seals, Shreveport, LA 71149–0369 (undated).

Ultimate Stainless Steel "Rainstopper" brochure, Southwestern Packing & Seals Shreveport, LA 71149–0369 (undated).

Parson Manhole Insert brochure, Parson Environmental Products, Inc., Reading, PA 19606 (undated).

The Man–Pan brochure, PDS Technologies, Irwin PA 15642 (undated).

Knutson Manhole Inserts brochure and advertisement, J.C. Utility Sales, Inc. Dallas, TX 75238 (undated).

Fosroc® Sewer Guard brochure (undated).

Fosroc® Sewer Guard SD brochure (undated).

Manhole Seal Kit Model MSK–1, Massaro Manufacturing, Inc. Buena Park, CA.

36" or 42" Watertight Manhole, New Installations, Massaro Manufacturing, Inc. Buena Park, California.

*Primary Examiner*—James Lisehora
*Attorney, Agent, or Firm*—Kennedy, Davis & Kennedy

[57] ABSTRACT

An entrance-deterring cap for manhole openings in which an annular pan has an annular flange extending laterally from a skirt for supporting the pan on an upper edge of a frame in a manhole opening. A support member comprises an elongate bar disposed outwardly of the pan with a pair of plates rigidly attached at distal ends of the bar. A threaded stud is attached to the elongate bar for insertion through an opening in the bottom of the pan whereby the plates of the bar are exposed outwardly of the skirt with the distal ends of the plates near the flange of the pan. An elongate flexible strand attached to the threaded stud extends through an opening in the pan for coupling the bar with the pan. The pan is supported by the flange on an upper surface of the frame in a manhole opening and the elongate bar is suspended by the flexible strand below the pan in a throat of the manhole opening. The strand is pulled in order to move the threaded stud through the opening in the pan. A nut within the pan is threadedly engaged to the stud to secure the bar to the pan and thereby bear the distal ends of the plates against a lower surface of the frame for locking the pan to the frame of the manhole opening. A method of deterring entrance through manhole openings is disclosed.

9 Claims, 2 Drawing Sheets

ENTRANCE-DETERRING CAP FOR MANHOLE OPENINGS

This application claims the benefit of U.S. Provisional Application Ser. No. 60/016,574, entitled Entrance-Deterring Cap For Manhole Openings filed Apr. 30, 1996 in the United States Patent and Trademark Office.

TECHNICAL FIELD

The present invention relates to a cap for closing manhole openings. More particularly, the present invention relates to a cap that permits authorized entrance and passage through a manhole opening into a cable vault while deterring unauthorized entrance and reducing ingress of water and dirt.

BACKGROUND OF THE INVENTION

For many years, communication and power lines have been carried above ground on spaced-apart poles placed along streets and right-of-ways. The trend in recent years, however, has been to enclose these lines in conduits which are buried below ground. Interchanges of these conduits are typically housed in subsurface vaults formed of cast concrete walls which are accessible through manhole openings. Typically, the manhole opening to the subsurface vault is defined by an annular cast iron frame which is attached to the concrete walls of the vault. A cast iron disk-like cover sits on a flange of the frame for closing the manhole opening.

While the cover is satisfactory for closing the manhole opening into the vault, there are problems which arise from use of conventional manhole covers to close openings to subsurface vaults. These problems include lack of significant resistance to unauthorized entry into the vault through the manhole and also water and debris infiltration into the vault. While the manhole covers used to close the manhole openings are typically heavy cast-iron disks, they are readily removed with pry bars and with relatively insignificant exercise of labor. Thus, access into unsecured manholes is relatively quick, and the communications and power cables are thereby easily accessible and at risk to vandalism. The relatively easy access through conventional manhole openings into the vault poses problems, as concerns regarding security for communication and power lines increase. Conventional wire lines are shielded but can be damaged by laborious cutting with tools. In contrast, fiber-optic lines are rather easily cut and damaged in a short time. Thus unsecured covers pose security risks due to the potential for unauthorized, but relatively easy, entrance into the vault.

Further, entry of water and dirt through the manhole opening into the vault also poses problems. The accumulated water in the vault can become contaminated by both devices in the vault and seepage of chemicals and contaminates into the vault. Conventional covers for manhole openings typically do not form perfect seals on the frame and storm water often leaks through the opening into the vault. Contaminants such as lead may leach into the water that collects in the vault. When work is to be done in the vault, the accumulated water must first be collected and tested for contaminates prior to disposal. Any contaminated water must be treated according to hazardous material regulations prior to disposal. Storage, handling, and treatment of the collected vault water is expensive, time consuming, and labor intensive.

Various devices and methods have been used to deter and delay access to vaults through manhole openings. One approach involves tapping a threaded bore into both the rim of the cover and the perimeter of the frame in which the cover sits. A bolt is screwed into the bore and thereby secures the cover to the frame. With this approach, however, the manhole would continue to experience ingress of water and debris into the vault.

Accordingly, there is a need in the art for a cap for permitting entrance into a subterranean vault while deterring unauthorized entrance and reducing the ingress of water and dirt into the vault. It is to such that the present invention is directed.

SUMMARY OF THE INVENTION

The present invention meets this need in the art by providing an entrance-deterring cap for manhole openings while reducing ingress of water and dirt into vaults through manhole openings. The entrance-deterring cap comprises an annular pan having a skirt that extends outwardly from a bottom of the pan. An annular flange extends laterally from a lip of the skirt for supporting the pan on an upper edge of a frame in a manhole opening. The bottom defines an opening therethrough for receiving a threaded stud. A securing member is disposed outwardly of the pan adjacent the bottom. In a preferred embodiment, the securing member is defined by an elongate cross-channel and a pair of perpendicularly disposed plates attached at respective distal ends of the cross-channel. A threaded stud rigidly attaches to the cross-channel medial the plates for insertion through the opening whereby the plates of the bar are disposed outwardly of the skirt with distal ends of the plates near the flange of the pan. A coupler connects the securing member to the pan. In a preferred embodiment, the coupler is a flexible cable that attaches to the threaded stud and extends into the pan through the opening therein. A nut is provided for threadingly engaging the stud within the pan in order to fasten the cross-channel of the securing member to the pan after the pan is positioned on a frame of a manhole opening. The pan, being supported by the flange on an upper surface of the frame in the manhole opening, is secured thereto by bearing the distal ends of the plates against a lower surface of the frame by engaging the nut to the stud within the pan.

In another aspect, the present invention provides a method of deterring unauthorized entrance into vaults through manhole openings while reducing ingress of water and dirt therethrough. The method positions an annular pan on an upper edge of a frame in a manhole opening. The pan has a skirt that extends outwardly from a bottom of the pan with an annular flange extending laterally from a lip of the skirt for supporting the pan on the frame. The pan is thereafter locked to the frame by engaging a support member to the pan and thereby bearing plates on the support member forcibly against a lower surface of the frame. In a preferred method, a flexible cable couples the support member to the pan. The cable attaches to a distal end of a threaded stud on the support member and extends through an opening in the pan. The cable is pulled to move the stud through the opening. A nut on the cable engages the threaded stud to secure the support member to the pan. The pan, being supported by its flange on an upper surface of a frame in a manhole opening, is secured thereto by bearing the distal ends of the plates against a lower surface of the frame by engaging the nut to the stud within the pan.

Objects, features, and advantages of the present invention will become apparent upon reading the following detailed description in conjunction with the drawings and the appended claims.

DETAILED DESCRIPTION OF THE PREFERRED EMBODIMENTS

Figure 1:
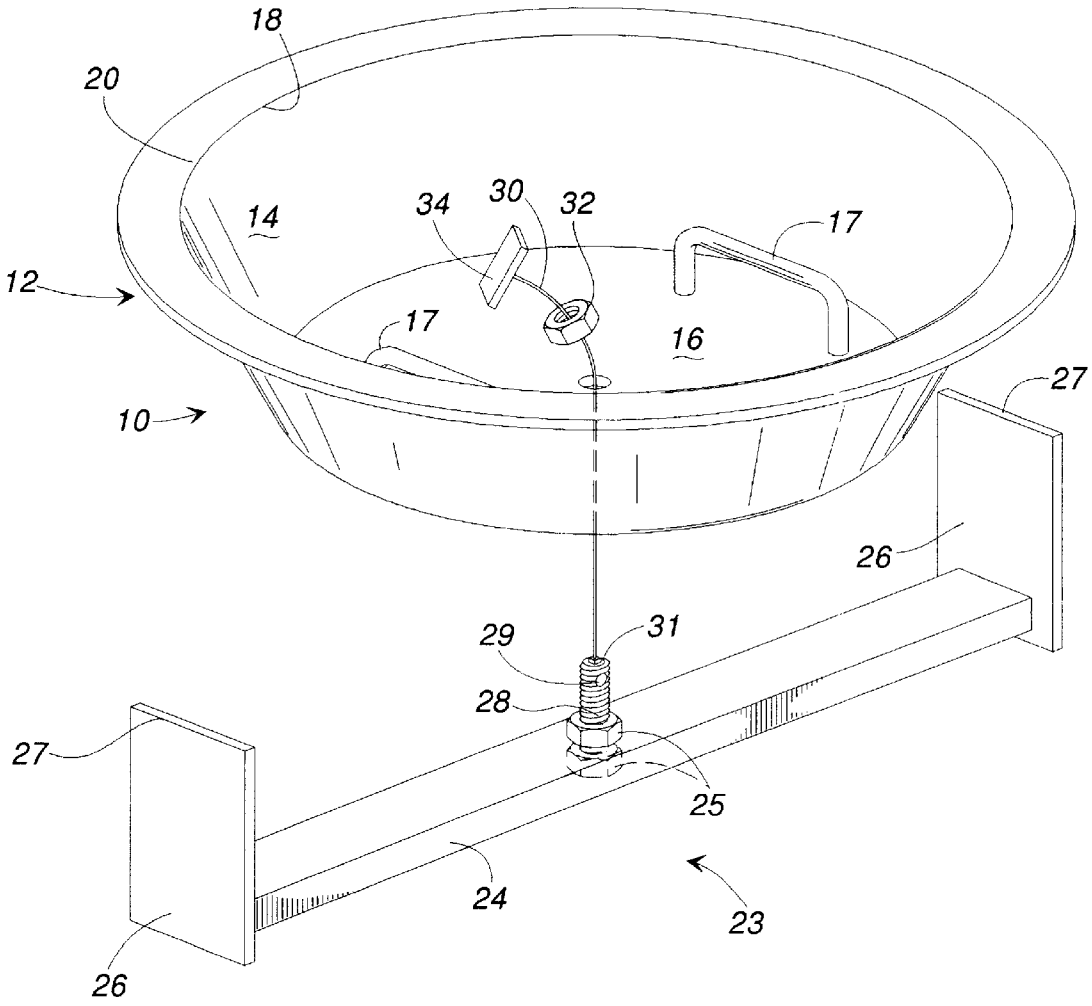
FIG. 1 is a perspective view of an entrance-deterring cap for a manhole opening according to the present invention.

Referring now in more detail to the drawings, in which like numerals indicate like parts throughout the several views, FIG. 1 illustrates in perspective view an entrance-deterring cap for a manhole opening to a subsurface vault. The cap 10 comprises an annular pan 12 having a perimeter skirt 14 which tapers outwardly at an angle from a bottom 16 of the pan. An annular flange 20 extends laterally from a distal edge 18, or lip, of the skirt 14. The flange 20 supports the pan 12 on an upper edge of a frame in a manhole opening, as discussed below. The bottom 16 of the pan 12 defines an opening 22. In a preferred embodiment, the opening 22 is in the center of the bottom 16, for a purpose discussed below. A pair of spaced-apart U-shaped handles 17 rigidly connect to the bottom 16.

A support member generally designated 23 is disposed outwardly of the pan 12 adjacent the bottom 16. The support member 23 is used to secure the pan 12 to the frame in the manhole opening as discussed below. In the illustrated embodiment, the support member 23 is substantially U-shaped in cross-sectional view. The support member 23 has an elongate bar 24 that extends along a diameter of the bottom 16 of the pan 12. In a preferred embodiment, the bar 24 is a U-shaped channel. The bar 24 has a pair of flat plates 26 rigidly attached at respective distal ends of the bar. The plates 26 are perpendicular to a longitudinal axis of the bar 24. The plates 26 are disposed outwardly of the skirt 14. When the bar 24 is connected to the bottom 16, the distal ends 27 of the plates are near the flange 20 for securing the pan 12 to the frame of the manhole opening, as discussed below.

A threaded stud 28 rigidly attaches to the elongate bar 24. In a preferred embodiment, the stud 28 attaches medial the plates 26 for centrally balancing the bar about the stud. The stud 28 in the illustrated embodiment is a threaded rod that inserts through an opening in the bar 24 and rigidly connects to the bar with a pair of nuts 25. As discussed below, the stud 28 extends through the opening 22 in the pan 12 and engages a nut in order to secure the bar 24 closely to the bottom 16 of the pan while disposing the plates 26 outwardly of the skirt 14 with the distal ends 27 of the plates near the flange 20 of the pan. In an alternate embodiment, the stud 28 is a bolt which extends through the hole in the channel which defines the bar 24. The bolt is welded to the channel. In a preferred embodiment, the stud 28 includes a transverse bore 29 in a distal portion, for a purpose discussed below.

The support member 23 is coupled to the pan 12 by an elongate flexible strand 30. The strand 30 holds the support member 23 near the pan 12 after the pan is placed on the frame in the manhole opening, as discussed below. The strand 30 rigidly attaches at a first end 31 to a distal end of the threaded stud 28. The strand 30 extends through the opening 22 in the pan 12 and receives thereon a nut 32 for threadingly engaging the stud 28. A handle 34 attaches to a second end of the strand 30 to hold the nut 32 on the strand and to prevent the pan and the support member 23 from separating. The handle 34 is also used for pulling the strand 30 through the opening 22 and thereby for inserting the stud 28 through the opening into the pan 12. In a preferred embodiment, the strand 30 is a steel cable.

Figure 2:
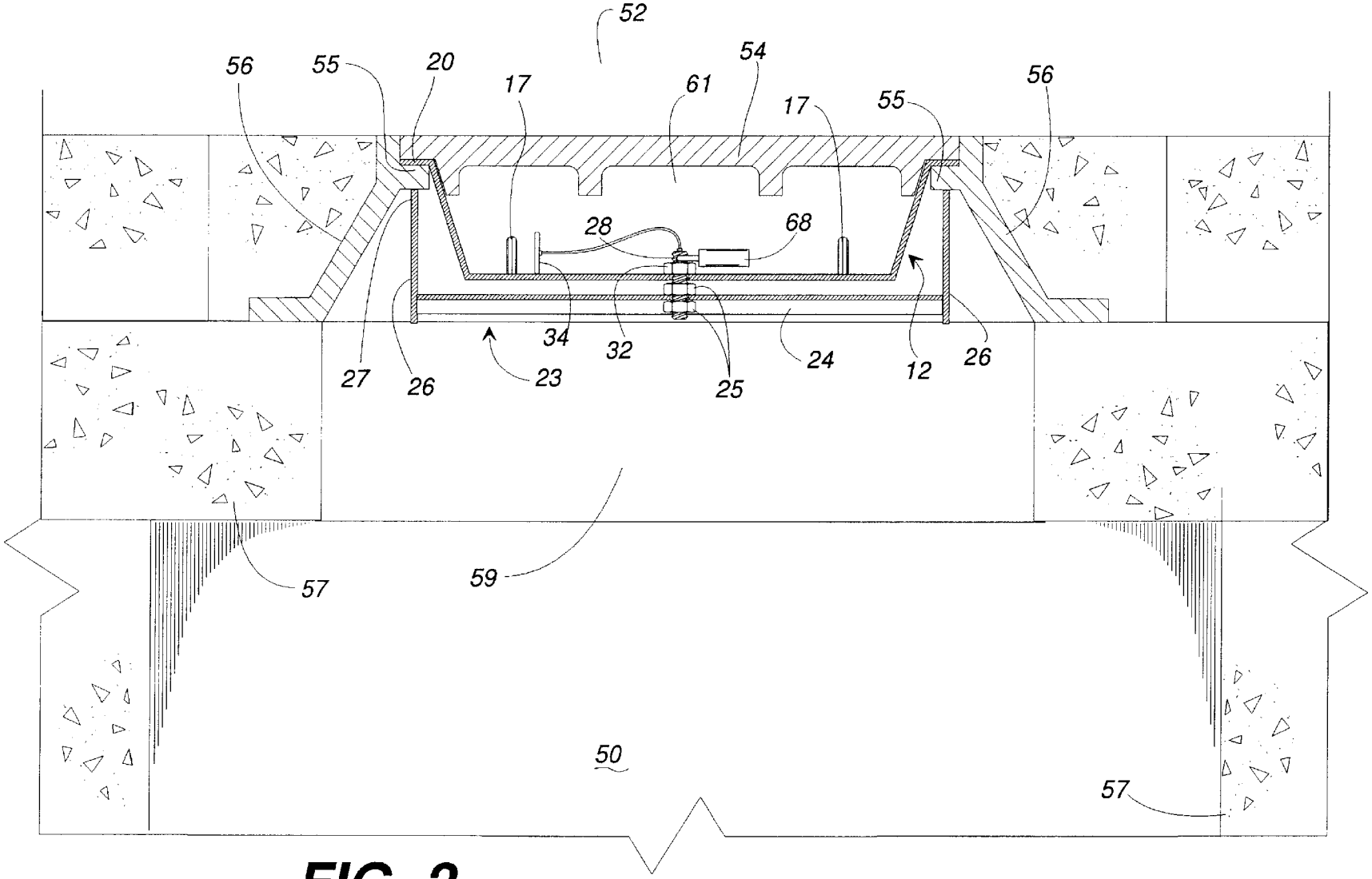
FIG. 2 is a cross-sectional view of a subsurface vault accessible through a manhole opening having the entrance-deterring cap illustrated in FIG. 1.

With reference to FIG. 2, the entrance-deterring cap of the present invention is used to deter entrance into a subsurface vault 50 through a manhole opening 52 which is closed conventionally by a manhole cover 54. In the illustrated embodiment, the vault 50 is formed with cement walls generally designated 57 which secures an annular frame 56 that defines the manhole opening 52. The manhole cover 54 sits on an annular flange-like lip 55 of the frame 56. The pan 12 and the support member 23 coupled to it are inserted into the manhole opening 52, by grasping the handles 17 in order to hold the pan 12 with the support member 23 suspended below by the stand 30. The support member 23 is inserted through the manhole opening 52 below the lip 55 of the frame 56. The support member 23, suspended by the flexible strand 30, hangs below the pan 12 in a throat 59 of the vault 50. Held by the handles 17, the pan 12 is positioned with the flange 20 supported on an upper surface of the lip 55. The pan 12 thereby closes the manhole opening 52 to the vault 50. The support member 23 is suspended on the strand 30 below the pan 12 in the throat 59.

The pan 12 thereafter is secured in place by connecting the support member 23 to the pan. Briefly, this involves moving the distal ends 27 of the plates 26 into engagement with a lower surface of the lip 55 of the frame 56 on which the pan 12 sits. Connecting the bar 24 to the pan 12 causes the distal ends 27 of the plates 26 to bear forcibly against the frame 56 and thereby lock the pan to the frame. In the illustrated embodiment, this is accomplished by first grasping the handle 34 and pulling, to pull the strand 30 through the opening 22 and the pan 12. The support member 23, preferably centrally supported from the stud 28 and thereby balanced, is readily pulled upwards towards the pan 12 by pulling the strand 30. The plates 26 are thereby disposed outwardly of the skirt 14 and the distal ends 27 of the plates 26 are moved into contact with the lower surface of the lip 55 of the frame 56 in which the pan 12 sits. The stud 28 is moved through the opening 22 and into an interior space 61 defined by the bottom 16 and the skirt 14 of the pan 12. The nut 32 slides down the strand 30 to the stud 28 and is threadingly engaged thereto to secure the bar 24 to the pan 12. This causes the distal ends 27 of the plates 26 to bear forcibly against the lower surface of the lip 55 and thereby lock the pan 12 to the frame 56.

As discussed above, the stud 28 further defines in a preferred embodiment the transverse bore 29. A shackle of a conventional padlock 68 inserts through the bore 29 after the nut 32 is tightened on the stud 28. Locking the padlock 68 prevents unauthorized removal of the nut 32 from the stud 28, and thereby secures the nut to the stud and deters entrance into the subsurface vault 50 through the manhole opening 52. The cap 10 accordingly is locked into the frame 56 to deter entrance into the vault 50. The manhole opening 52 is thereafter closed by positioning the conventional manhole cover 54 on the frame 56 of the manhole opening. In an alternate embodiment (not illustrated), a shroud encloses the padlock 68 when it is locked to the stud 28, for additional security. The shroud connects to the pan with bolts passing through bores in a flange of the shroud.

The pan 12 also resists entry of water and dirt into the vault 50 by trapping water and dirt in the cavity 61 between the bottom 16 of the pan and the manhole cover 54. In an alternate embodiment, the lower surface of the flange 20 includes a gasket to seal against water entry into the vault. The gasket is flexible to conform to surface irregularities of the lip 55 in the frame 56.

To gain access to the vault 50, the cover 54 is removed conventionally. The padlock 68 is removed, and the nut 32 unscrewed from the stud 28. The support member 23 is thereby detached from the locking the pan 12 to the frame 56. The strand 30 is slipped downwardly through the opening 22 to suspend the support member 23 below the pan 12. The pan 12 with the support member 23 is then lifted out of the manhole opening 52 by grasping and pulling on the handles 17 with the support member 23 following. One embodiment does not include the handles 17. The pan 12 is installed and removed by grasping the flange 20 of the pan 12.

In a preferred embodiment, a threaded rod secured by the nuts 25 is used for the stud 28. This enables an installer to adjust the length of the stud that extends outwardly of the bar 24, and thereby adjust the length of the stud that extends into the pan 12 through the opening 22. The cap 10 accordingly can be installed in manholes that have different frame structures and dimensions. Adjusting the length of the stud 28 allows the cap 10 to be installed on manhole frames 56 which have lips 55 of different thicknesses and enables the installer to use additional space in the cavity 61 if necessary between the bottom 16 of the pan 12 and the hole 29 in the stud 28 for receiving the padlock 68.

In one embodiment, the bottom 16 and the flange 20 of the pan 12 are manufactured from 14-gauge stainless steel and the skirt 14 is made of 16-gauge steel. The pan 12 however, can be made of cast iron or molded using a high-impact plastic. In another embodiment, the pan 12 is manufactured from a single sheet of stainless steel that is spun conventionally on a mandrel against rollers and formers to bend the sheet to the pan shape with the outwardly extending flange. For a conventional manhole opening of 31 inches, the bottom 16 of the pan 12 has a diameter of 29 and ½ inches. The pan 12 has a diameter of 31 and ⅜ inches, measured across the flange 20 at the open end of the pan. The depth of the pan 12 is 5 and ¾ inches. The bottom 16 includes a 1 inch hole centered in the bottom. The bar 24 is preferably a steel channel that is 1 inch by 2 inches and has a length of 31 and ⅛ inches, which slightly exceeds the diameter of a conventional 31 inch manhole opening, for engaging the lower surface of the frame 56 in the manhole opening 52. The plates 26 are ¼ inch by 2 inch by 7¾ inch flat stock steel plate. A ½ inch portion extends below the channel which defines the bar 24. The plates 26 are preferably welded to the distal ends of the channel. In an alternate embodiment, the stud 28 is defined by a bolt that is welded to the channel.

The cap 10 of the present invention is readily installed in manhole openings 52 and is readily removed for authorized entrance, while deterring unauthorized entrance and reducing water and dirt ingress into the vault 50 through the manhole opening 52. The principles, preferred embodiments, and modes of operation of the present invention have been described in the foregoing specification. The invention is not to be construed as limited to the particular forms disclosed, because these are regarded as illustrative rather than restrictive. Moreover, variations and changes may be made by those skilled in the art without departing from the spirit of the invention as set forth in the following claims.

What is claimed is:

1. An entrance-deterring cap for manhole openings, comprising:

an annular pan having a skirt extending from a bottom of the pan with an annular flange extending laterally from a distal edge of the skirt for supporting the pan on an upper edge of a frame in a manhole opening, the bottom defining a central opening therethrough;

a securing member defined by an elongate cross-channel and a pair of perpendicularly disposed plates attached at respective distal ends of the cross-channel, the securing member disposed outwardly of the pan adjacent the bottom;

a threaded stud rigidly attached to the cross-channel medial the plates for insertion through the central opening in the bottom of the pan, whereby the plates of the securing member are disposed outwardly of the skirt with the distal ends of the plates near the flange of the pan;

a coupler connecting the securing member to the pan; and a nut for threadingly engaging the stud within the pan to fasten the bar to the bottom of the pan, whereby the pan, being supported by the flange on an upper surface of a frame in a manhole opening, is secured thereto by bearing the distal ends of the plates against a lower surface of the frame by engaging the nut to the stud within the pan.

2. The entrance-deterring cap as recited in claim 1, wherein the threaded stud defines a transverse bore in a distal portion of the stud, whereby a padlock, its shackle being inserted through the transverse bore after the nut is engaged to the stud, prevents unauthorized removal of the cap.

3. The entrance-deterring cap as recited in claim 1, further comprising a pair of spaced-apart U-shaped handles rigidly connected to the bottom of the pan, for grasping and holding the pan during installation and removal from a manhole opening.

4. An entrance-deterring cap for manhole openings, comprising:

an annular pan having a skirt extending from a bottom of the pan with annular flange extending laterally from a lip of the skirt for supporting the pan on an upper edge of a frame in a manhole opening, the bottom defining a central opening therethrough;

an elongate bar disposed outwardly of the pan adjacent the bottom and having a pair of plates rigidly attached as respective distal ends of the bar;

a threaded stud rigidly attached to the elongate bar for insertion through the central opening whereby the plates of the bar are disposed outwardly of the skirt with the distal ends of the plates near the flange of the pan;

an elongate flexible strand rigidly attached at a first end to a distal end of the threaded stud and extending through the central opening in the pan for coupling the bar with the pan;

a nut received on the strand within the pan and sized for threadingly engaging the stud to fasten the bar to the bottom of the pan; and a handle attached to a second end of the strand for pulling the strand through the central opening and thereby extending the threaded stud through the central opening into the pan, whereby the pan, being supported by the flange on an upper surface of a frame in a manhole opening, is secured thereto by bearing the distal ends of the plates against a lower surface of the frame by engaging the nut to the stud within the pan.

5. The entrance-deterring cap as recited in claim 4, wherein the threaded stud defines a transverse bore in a distal portion of the stud, whereby a padlock, its shackle being inserted through the transverse bore after the nut is engaged to the stud, prevents unauthorized removal of the cap.

6. The entrance-deterring cap as recited in claim 4, further comprising a pair of spaced-apart U-shaped handles rigidly connected to the bottom of the pan, for grasping and holding the pan during installation and removal from a manhole opening.

7. A method of deterring entrance through a manhole opening, comprising the steps of:

(a) positioning an annular pan on an upper surface of a frame in a manhole opening, the annular pan having a skirt extending from a bottom with an annular flange extending laterally from a distal edge of the skirt, the flange supporting the pan on the frame, with a support member hanging below the pan in the manhole opening coupled by an elongate flexible strand to the pan; and (b) locking the pan to the frame by engaging the support member to the pan, the support member having a pair of plates that extend upwardly to bear forcibly on a lower surface of the frame when the support member is engaged to the pan.

8. The method as recited in claim 7, wherein locking the pan comprises the steps:

(c) pulling the elongate flexible strand which is rigidly attached at a first end to a distal end of a threaded stud extending from the support member through an opening in the pan, whereby the threaded stud is pulled through the opening in the pan; and (d) securing the stud to the pan by screwing a nut onto the stud within the pan, whereby the pan, being supported by the flange on the upper surface of a frame in the manhole opening, is secured thereto by bearing the distal ends of the plates against a lower surface of the frame upon engaging the nut to the stud within the pan.

9. The method as recited in claim 8, further comprising the step of (e) locking a padlock with its shackle passing through a transverse bore in a distal portion of the threaded stud, thereby restricting unauthorized disengagement of the support member.

* * * * *